US005991972A

United States Patent [19]

Krebs et al.

[11] Patent Number: 5,991,972

[45] Date of Patent: Nov. 30, 1999

[54] HEIGHT ADJUSTMENT MECHANISM FOR A CLEANING TOOL

[75] Inventors: Alan Joseph Krebs, Stanwood; Craig Richard Cummins, Manton, both of Mich.

[73] Assignee: Rexair, Inc., Troy, Mich.

[21] Appl. No.: 09/020,433

[22] Filed: Feb. 9, 1998

[51] Int. Cl.[6] ..... A47L 5/34

[52] U.S. Cl. ..... 15/354; 15/377

[58] Field of Search ..... 15/354, 355, 359

[56] References Cited

U.S. PATENT DOCUMENTS

| | | | |
|---|---|---|---|
| 358,009 | 5/1887 | Burkhardt . | |
| 2,776,446 | 1/1957 | Brace | 15/359 |
| 2,823,412 | 2/1958 | Kirby | 15/354 |
| 3,676,892 | 7/1972 | Nordeen | 15/359 |
| 4,083,079 | 4/1978 | Vermillion | 15/354 |
| 4,437,205 | 3/1984 | Koland | 15/354 |
| 4,467,495 | 8/1984 | Fish et al. | 15/354 |

*Primary Examiner*—Chris K. Moore
*Attorney, Agent, or Firm*—Howard & Howard

[57] ABSTRACT

A cleaning tool having a height adjustment mechanism which may be overridden to prevent damage to the cleaning tool in the event an excessively high force is applied to an exterior surface of the cleaning tool. The height adjustment mechanism forms an overrideable clutch having a manually adjustable thumbwheel, a biasing member and a clutch member. The height adjustment assembly is operably associated with a roller assembly which supports the cleaning tool on a work surface at a desired height above the work surface. The application of a predetermined excessive force to an exterior surface of the cleaning tool causes the height adjustment assembly to be de-clutched to allow the lower surface of the cleaning tool to come in contact with the work surface, thereby preventing damage to the various internal components of the cleaning tool.

21 Claims, 3 Drawing Sheets

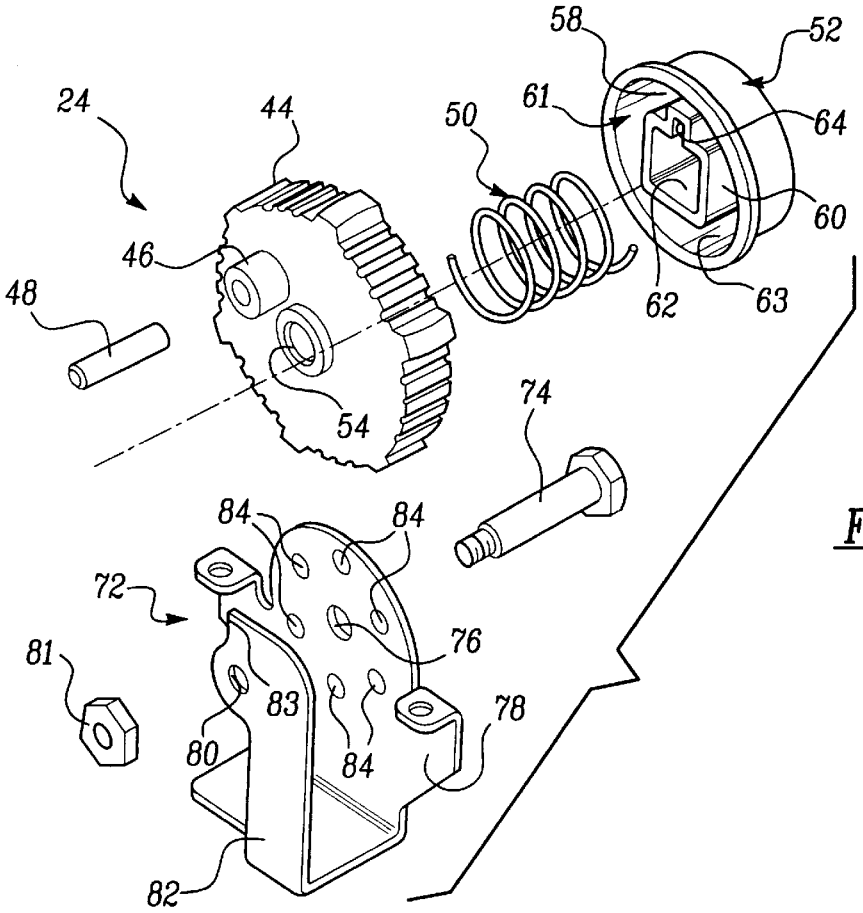
Fig-5
Fig-8
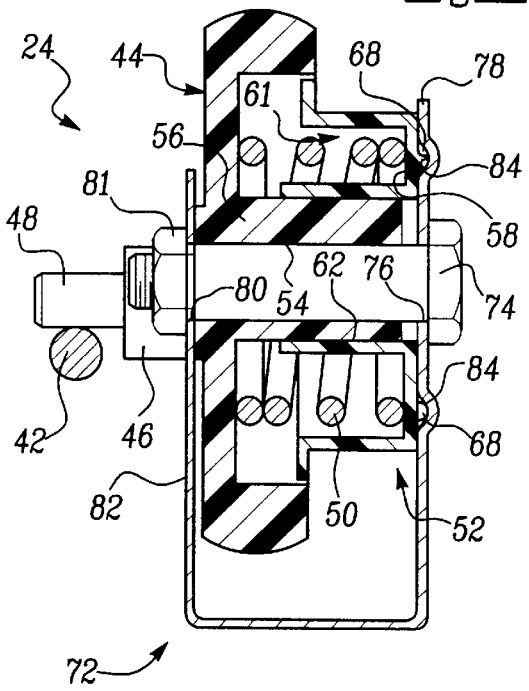
Fig-9
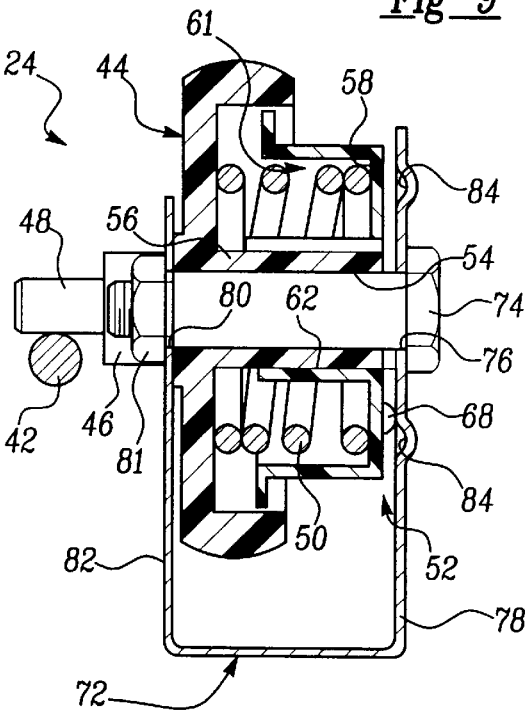

HEIGHT ADJUSTMENT MECHANISM FOR A CLEANING TOOL

BACKGROUND OF THE INVENTION

1. Technical Field

This invention relates to cleaning tools, and more particularly to a cleaning tool for a vacuum cleaner apparatus, wherein the cleaning tool includes a height adjustment mechanism which permits a main body portion of the cleaning tool to be collapsed into contact with the work surface in the event a predetermined excessive force is applied to the main body portion of the cleaning tool and to thus prevent damage to one or more roller assemblies supporting the main body portion above the work surface.

2. Discussion

Vacuum cleaner apparatuses are often used in connection with cleaning tools having a rotatable brush member. The rotatable brush member may be motor driven or simply rotatably mounted within a main body portion of the cleaning tool. Typically, the main body portion of the cleaning tool is supported by at least one roller assembly at a distance above a work surface being cleaned that still allows bristles of the brush member to come in contact with the work surface.

With such cleaning tools it is highly desirable to provide some form of height adjustment mechanism which allows the main body portion of the tool supporting the brush member to be moved closer to or farther away from the work surface. This permits the cleaning tool to be used conveniently on various types of work surfaces such as carpeting, hardwood floors, etc. while optimizing the ability of the cleaning tool to pick up dirt and debris and still be easy for the user to move over the work surface. Without some form of height adjustment mechanism, the brush member, which is mounted within the main body portion, can not be optimally spaced from the work surface to achieve maximum pickup of dirt and debris.

With many previously developed height adjustment mechanisms, however, no provision is included for allowing the height adjustment mechanism to be "overridden" or released if a force sufficient to cause damage to the roller assemblies supporting the main body portion is applied to the main body portion of the cleaning tool. Thus, with many previously developed cleaning tools, if a user was to accidentally step on an upper surface of the tool, or if a piece of furniture was accidentally set on the cleaning tool, the roller assemblies supporting the main body portion and the brush member above the work surface could be damaged.

It would therefore be highly desirable to provide a height adjustment mechanism for a cleaning tool that allows a user to set the brush member within the cleaning tool at a desired height above the work surface, and also provides the benefit of permitting the main body portion of the cleaning tool to be "collapsed" onto the work surface in the event a predetermined force is applied to the cleaning tool. In this manner, the roller assemblies supporting the main body portion above the work surface could not be subjected to an applied force sufficient to break them.

It would further be highly desirable if such a height adjustment mechanism as described above could be provided through a compact mechanism having a limited number of parts, that does not add significantly to the overall cost of the cleaning tool.

SUMMARY OF THE INVENTION

The present invention relates to a cleaning tool having a height adjustment mechanism that is overridden if a predetermined force which could cause damage to various components of the cleaning tool is applied to the cleaning tool. The cleaning tool includes at least one roller assembly which supports a main body portion of the cleaning tool at a user selected height above a work surface. The height adjustment mechanism cooperates with the roller assembly and the main body portion to hold the main body portion at the user selected height above the work surface. The height adjustment mechanism automatically disengages or "de-clutches" to permit the main body portion to be lowered into contact with the work surface when a predetermined force is applied to the main body portion. Thus, the roller assembly, which otherwise supports the weight of the cleaning tool, is never subjected to a force sufficient to damage it.

The height adjustment mechanism of the cleaning tool includes a user adjustable height adjustment wheel that protrudes from the main body portion and is rotatable. The height adjustment wheel is rotationally supported to a mounting member having a first engaging structure. In a preferred embodiment, the first engaging structure comprises a plurality of recesses formed on a support wall of the mounting member. A clutch member is included that is keyed to the height adjustment wheel so as to be rotated concurrently with the height adjustment wheel. The clutch member is further coupled to the height adjustment wheel so as to be movable generally slidably towards and away from the height adjustment wheel. The clutch member has an end wall having a second engaging structure. In the preferred embodiment, this second engaging structure comprises one or more protrusions formed on the end wall. A biasing member is also interposed between the clutch member and the height adjustment wheel and biases the one or more protrusions towards and into engagement with the plurality of recesses in the mounting member when the height adjustment wheel and the clutch member are secured to the mounting member in a "clutched" position. The recesses are further disposed so as to interengage with the protrusions on the end wall of the clutch member at a plurality of predetermined positions corresponding to varying height levels of the cleaning tool, thus providing the user with a plurality of different height adjustment levels at which the cleaning tool may be set relative to the work surface.

The height adjustment mechanism of the present invention provides the significant advantage that it may be "overridden" or "de-clutched" if a predetermined force is applied to the cleaning tool. When force is applied to the cleaning tool the force is transmitted to the height adjustment wheel by the roller assembly, this transmission causes the height adjustment wheel to attempt to turn the clutch member, which is engaged with the recesses of the mounting member. Once the predetermined force has been applied, the biasing member allows the clutch member to be urged out of engagement with the recesses in the mounting member and to rotate freely together with the height adjustment wheel. Rotation of the height adjustment wheel allows the main body portion to be lowered into contact with the work surface. In this manner, the roller assemblies supporting the main body portion above the work surface are never forced to bear a high force that could cause damage to them or to other components within the cleaning tool.

The height adjustment mechanism of the cleaning tool is designed with a limited number of independent component parts that are relatively easily and inexpensively constructed and assembled. Thus, the height adjustment mechanism does not add significantly to the overall cost of the cleaning tool or its complexity of manufacture.

BRIEF DESCRIPTION OF THE DRAWINGS

The various advantages of the present invention will become apparent to one skilled in the art by reading the following specification and subjoined claims and by referencing the following drawings in which:

FIG. 5 is an exploded perspective view of the components of the height adjustment mechanism;

FIG. 8 is a cross sectional view in accordance with section line 8—8 in FIG. 4 illustrating the height adjustment mechanism in an engaged or clutched position to maintain the cleaning tool at a desired height above the work surface; and FIG. 9 is a view of the cleaning tool of FIG. 8 illustrating the height adjustment mechanism in a disengaged or de-clutched position.

DETAILED DISCUSSION OF THE PREFERRED EMBODIMENTS

Figure 1:
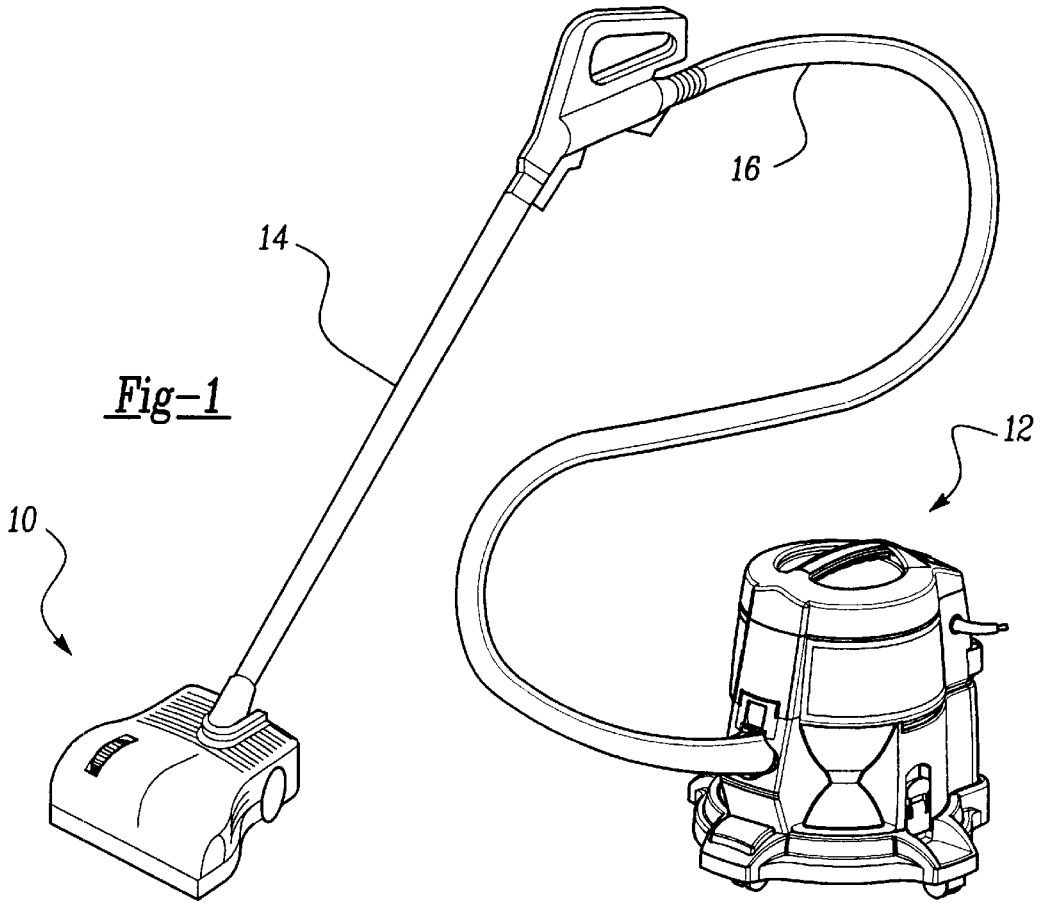
FIG. 1 is an environmental view illustrating a vacuum cleaner system coupled via a vacuum hose to a cleaning tool in accordance with the present invention.

Referring to FIG. 1, there is shown a cleaning tool 10 in accordance with a preferred embodiment of the present invention. The cleaning tool 10 is of the type incorporating a brush member (not shown) which may be motor driven or simply rotatably mounted for manual rotation. The cleaning tool 10 is coupled to a vacuum cleaner assembly 12 via a wand 14 and a vacuum hose 16. It will be appreciated, however, that the cleaning tool 10 could be formed as part of a conventional, upright vacuum cleaner. The vacuum cleaner assembly 12 shown in FIG. 1 is a liquid bath type vacuum cleaner assembly 12 commercially available from the assignee of the present application, and is shown merely to illustrate one popular application of the cleaning tool 10.

Figure 2:
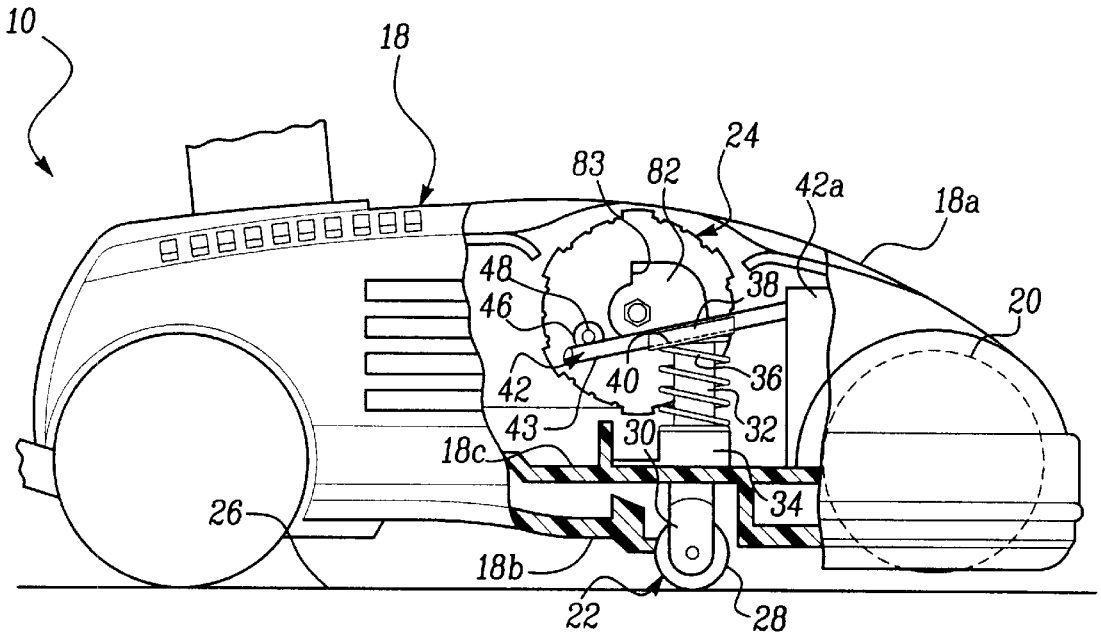
FIG. 2 is a side, partial cross sectional view of the cleaning tool of FIG. 1 illustrating a main body portion of the cleaning tool held at a preselected height above a work surface by a roller assembly of the cleaning tool.

Referring to FIG. 2, the cleaning tool 10 generally includes a main body portion 18 having a rotationally supported brush member 20. The brush member 20, as explained above, may be motor driven or merely manually driven. A roller assembly 22 is used in connection with a height adjustment mechanism 24 to adjust the height of the main body portion 18, and thus the brush member 20, above a work surface 26. It will be appreciated that during normal operation the roller assembly 22 supports substantially the entire weight of the cleaning tool 10. Thus, if any force is applied to an upper surface 18*a* of the cleaning tool 10, the roller assembly 22 would ordinarily be required to support the force. As can be appreciated, if a high force is applied to the upper surface 18*a*, the roller assembly 22 could potentially be damaged if the force is transmitted to the roller assembly 22.

With further reference to FIG. 2, the roller assembly 22 includes a shaft portion 32 that is supported slidably within a guide portion 34 of the main body portion 18. A coil spring 36 provides a biasing force between a head portion 38 on a first end of the shaft portion 32 and the guide portion 34 and tends to bias the roller 28 upwardly in the drawing of FIG. 2. While only one roller assembly 22 is shown, it will be appreciated that preferably a pair of roller assemblies 22 are included.

With further reference to FIG. 2, the head portion 38 includes a channel 40 which accepts a portion of a pivot bar 42. When the pivot bar 42 is urged downwardly, it compresses the coil spring 36 and moves the roller 28 downwardly so as to extend it further outwardly of a lower surface 18*b* of the main body portion 18. As can be appreciated, the further that roller 28 is urged outwardly, the more the lower surface 18*a* is lifted above the work surface 26. If two roller assemblies 22 are incorporated into the cleaning tool 10, then the pivot bar 42 can be formed in a U-shape so as to control operation of the second roller assembly concurrently with roller assembly 22. This is provided that the pivot bar 42 is pivotally mounted at a central point, such as point 42*a*, to internal structure of the housing 18 so that pivoting of the pivot bar 42 concurrently urges both roller assemblies upwardly or downwardly. A second end of the shaft portion 32 includes a yoke 30 that rotationally supports a roller 28.

Referring now to FIG. 5, the height adjustment mechanism 24 is illustrated. The mechanism 24 includes a manually actuatable height adjustment or thumbwheel 44 having a boss portion 46. The boss portion 46 has a pivot pin 48 press fit therein. With brief reference to FIG. 2, the pivot pin 48 can be seen to extend perpendicular to the pivot bar 42 and the thumbwheel 44 so as to be in position to contact the pivot bar 42. Thus, by manually rotating the thumbwheel 44 in a counterclockwise direction or a clockwise direction, an end 43 of the pivot bar 42 can be urged downwardly or allowed to lift upwardly respectively to control the extension positioning of the roller assembly 22 below the lower surface 18*b* of the main body portion 18.

Figure 7:
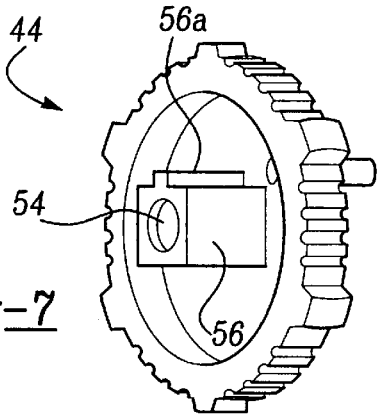
FIG. 7 is a perspective view of a height adjustment wheel illustrating a protruding neck portion thereof.

Referring further to FIG. 5, the height adjustment mechanism 24 also includes a biasing member 50 and a clutch member 52. The thumbwheel 44 also includes a centrally disposed opening 54. With brief reference to FIG. 7, the thumbwheel 44 also includes a protruding neck portion 56. The neck portion 56 has a rib 56*a* formed thereon.

Figure 6:
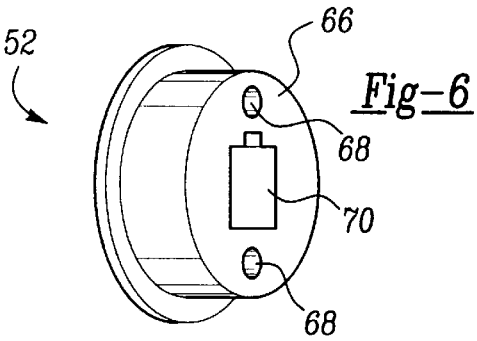
FIG. 6 is a perspective view of a clutch member illustrating the protrusions on an end wall thereof.

With reference to FIG. 5, the clutch member 52 includes an inner wall 58 having a boss portion 60 protruding therefrom. A channel 61 is formed between the boss portion 60 and an inner circumferential wall 63. The boss portion 60 has a hollowed out central area 62 having a channel 64. With specific reference to FIG. 6, the clutch member 52 also includes an end wall 66 having a plurality of protrusions 68 formed thereon. An opening 70 is formed centrally in the end wall 66.

With further reference to FIG. 5, the thumbwheel 44, biasing member 50 and clutch member 52 are secured to a mounting bracket 72. The mounting bracket 72 includes a support wall 78 having a hole 76 and a stop member 82 having a hole 80 and a stop surface 83. A shaft or other like member 74 extends along a longitudinal axis through hole 76, through opening 70 in the clutch member 52, through the biasing member 50, through opening 54, and through hole 80 in the stop member 82. A locknut 81 is secured to one end of member 74. Member 74 thus mounts thumbwheel 44, biasing member 50, and clutch members 52 in mounting bracket 72. The mounting bracket 72 also includes a plurality of recesses 84 spaced circumferentially around hole 76 at predetermined positions. Alternatively, the recesses 84 could be replaced by a plurality of holes formed in the support wall 78. The mounting bracket 72 is fixedly secured to an inner wall (shown in FIG. 2) 18*c* of the main body portion 18 closely adjacent the roller assembly 22.

With further reference to FIG. 5, the height adjustment mechanism 24 is assembled such that one end of the biasing member 50 is disposed within channel 61 and the other end of the biasing member fits over the protruding neck portion 56 of the thumbwheel 44. Protruding neck portion 56 is received in hollowed central area 62 and rib 56*a* is received in channel 64 to cause the clutch member 52 to be "keyed" to the thumbwheel 44. Thus clutch member 52 and thumbwheel 44 rotate about the longitudinal axis and member 74, and clutch member 52 is free to move slidably along the longitudinal axis towards and away from thumbwheel 44. Because of biasing member 50, it will be appreciated that during assembly the clutch member 52 and thumbwheel 44 must be squeezed together slightly to preload the mechanism 24 before same is inserted into mounting bracket 72 and secured thereto by the member 74.

With reference now to FIG. 8, once the height adjustment mechanism 24 is assembled, biasing member 50 constantly urges clutch member 52 against support wall 78. When the protrusions 68 are aligned with a pair of recesses 84, thumbwheel 44 and clutch member 52 are held stationary in a clutched position. This maintains the rollers 28 at one of a plurality of extended positions a desired position relative to the lower surface 18*b* of the main body portion 18. In this regard it will be appreciated that the positioning of the recesses 84 determines the specific heights at which the main body portion 18 will be supported above the work surface 26 (FIG. 2). Furthermore, although the presently preferred embodiment incorporates a pair of protrusions 68 for engaging an associated pair of recesses 84, it will be appreciated that a single protrusion 68 could also be used.

Figure 3:
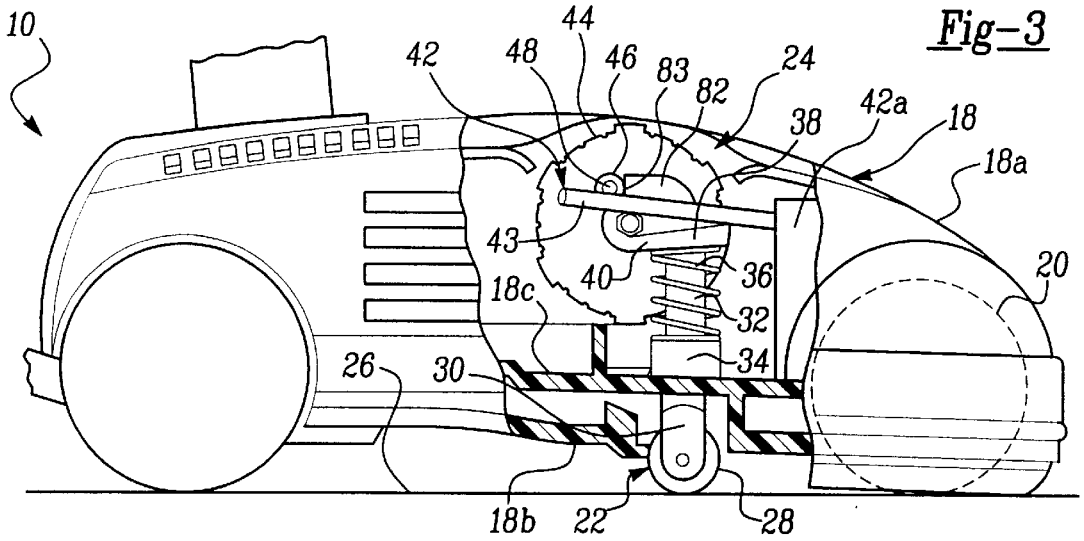
FIG. 3 is a view of the cleaning tool of FIG. 2 showing the main body portion collapsed into contact with the work surface when a predetermined force is applied to the cleaning tool.
Figure 4:
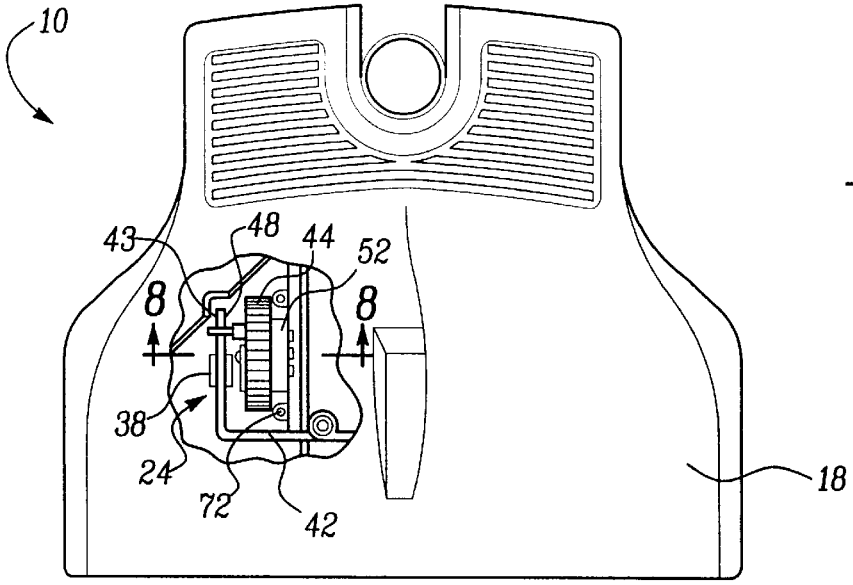
FIG. 4 is a fragmentary plan view of the cleaning tool of FIG. 1 illustrating a height adjustment mechanism incorporated therein.

Referring now to FIGS. 2, 3 and 9, if a force exceeding a predetermined force is applied to the upper surface 18*a* of the main body portion 18, the roller assembly 22 transfers the force to the pivot bar 42. The pivot bar 42 exerts an upward force on the pivot pin 48 which urges the thumbwheel 44 and clutch member 52 clockwise. The biasing member 50 allows the clutch member 52 to be urged inwardly towards the thumbwheel 44 as the protrusions 68 (FIG. 6) are urged out of the recesses 84 by the clockwise rotation of clutch member 52. Thus, the height adjustment mechanism 24 may be "overridden" by the predetermined force to prevent damage thereto or to other components of the cleaning tool 10. The clutch member 52 is shown in FIG. 9 in a disengaged de-clutched position after the protrusions 68 thereon have moved out of the recesses 84. The maximum clockwise rotation of the thumbwheel 44 is limited by pivot pin 48 contacting stop surface 83 of stop member 82 as shown in FIG. 3. The cleaning tool 10 is shown in FIG. 3 "collapsed" against the work surface 26, in this condition the roller assembly 22 is in a retracted position within the main body portion 18.

The height adjustment mechanism 24 thus forms a means by which the cleaning tool 10 can be held at various desired heights relative to the work surface 26 while still being de-clutchable in the event a pre-determined force is applied to the cleaning tool 10. In this manner, breakage to the various internal components of the cleaning tool 10 can be avoided if, for example, a heavy object is set on the cleaning tool 10 or the user accidentally steps on the tool 10.

The various components of the height adjustment mechanism 24 may be manufactured from suitably high strength plastics or metal. Since a relatively few number of independent component parts are used, the height adjustment mechanism 24 forms a very low cost, simple to assemble and reliable means for effecting height adjustment control of the cleaning tool 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A cleaning tool for a vacuum cleaner assembly having a main body portion and a height adjustment mechanism, said height adjustment mechanism comprising:

at least one roller assembly supporting said main body portion and movable between at least one extended position and a retracted position relative to said main body portion;

a clutch member having a second engaging surface and rotatably secured to a mounting bracket having a first engaging surface, said clutch member mechanically connected to said roller assembly;

a biasing member biasing said second engaging surface of said clutch member against said first engaging surface of said mounting bracket;

said clutch member movable between a clutched position and a de-clutched position when a predetermined force is applied to said main body portion;

said clutch member maintaining said roller assembly at said at least one extended position when said clutch member is at said clutched position and permitting said roller assembly to move to said retracted position when at said de-clutched position.

2. A cleaning tool for a vacuum cleaner having a main body portion and a height adjustment mechanism as claimed in claim 1 wherein said second engaging surface includes at least one protrusion and said first engaging surface includes a plurality of recesses, said at least one protrusion received in one of said plurality of recesses when said clutch member is at said clutched position and said at least one protrusion displaced from said one of said plurality of recesses when said clutch member is at said de-clutched position.

3. A cleaning tool for a vacuum cleaner having a main body portion and a height adjustment mechanism as claimed in claim 1 wherein said second engaging surface includes at least one protrusion and said first engaging surface includes a plurality of holes, said at least one protrusion received in one of said plurality of holes when said clutch member is at said clutched position and said at least one protrusion displaced from said one of said plurality of holes when said clutch member is at said de-clutched position.

4. A cleaning tool for a vacuum cleaner having a main body portion and a height adjustment mechanism as claimed in claim 1 further comprising a thumbwheel rotatably secured to said mounting bracket;

said thumbwheel slidably keyed to said clutch member and said biasing member located between said clutch member and said thumbwheel, said biasing member biasing said thumbwheel away from said clutch member;

a pivot bar mechanically coupled to said thumbwheel; and rotation of said thumbwheel rotating said pivot bar and moving said roller assembly between a plurality of extended positions relative to said main body portion.

5. A cleaning tool for a vacuum cleaner having a main body portion and a height adjustment mechanism as claimed in claim 4 wherein said thumbwheel further includes a projecting neck portion having a rib and extending perpendicularly to said thumbwheel;

said clutch member further includes a boss portion having a hollowed central area with a channel, said boss portion extending perpendicularly from said clutch member; and said neck portion is slidably received in said boss portion thereby keying said thumbwheel to said clutch member.

6. A cleaning tool for a vacuum cleaner having a main body portion and a height adjustment mechanism as claimed in claim 4 wherein said height adjustment mechanism includes a plurality of said roller assemblies and rotation of said pivot bar moves each of said roller assemblies between said plurality of extended positions.

7. A cleaning tool for a vacuum cleaner having a main body portion and a height adjustment mechanism as claimed in claim 4 wherein said roller assembly further includes a shaft portion having a first end and a second end, said first end including a channel, said channel receiving said pivot bar, said second end having a yolk rotatably supporting a roller; and said main body portion includes a guide portion, said shaft portion slidably received in said guide portion.

8. A cleaning tool for a vacuum cleaner having a main body portion and a height adjustment mechanism as claimed in claim 7 wherein said roller assembly further includes a coil spring;

said coil spring slidably received on said shaft portion between said channel and said guide portion; and said coil spring biasing said channel away from said guide portion.

9. A cleaning tool for a vacuum cleaner assembly having a main body portion and a height adjustment mechanism, said height adjustment mechanism comprising:

at least one roller assembly movable between a plurality of extended positions and a retracted position relative to said main body portion, said roller assembly supporting said main body portion;

a pivot bar operatively connecting said roller assembly to a thumbwheel;

said thumbwheel secured to a mounting bracket and rotatable about a longitudinal axis, rotation of said thumbwheel moving said at least one roller assembly between said retracted position and said plurality of extended positions;

a key mechanism keying said thumbwheel to a clutch member, said key mechanism rotating said clutch member concurrently with a rotation of said thumbwheel, said key mechanism permitting longitudinal movement of said clutch member along said longitudinal axis independent from longitudinal movement of said thumbwheel along said longitudinal axis;

said clutch member rotatably secured to said mounting bracket, said clutch member movable between a clutched position and a de-clutched position in response to one of rotation of said thumbwheel or a pre-determined force applied against said main body portion; and said clutch member maintaining said at least one roller assembly at any one of said plurality of extended positions when said clutch member is at said clutched position and permitting said roller assembly to move between said plurality of extended positions and said retracted position when at said de-clutched position.

10. A cleaning tool for a vacuum cleaner assembly having a main body portion and a height adjustment mechanism as claimed in claim 9 wherein said thumbwheel further includes a pivot pin extending perpendicularly to the rotational plane of said thumbwheel and contacting said pivot bar.

11. A cleaning tool for a vacuum cleaner assembly having a main body portion and a height adjustment mechanism as claimed in claim 9 further including a plurality of roller assemblies.

12. A cleaning tool for a vacuum cleaner assembly having a main body portion and a height adjustment mechanism as claimed in claim 11 wherein said pivot bar is substantially U-shaped, said pivot bar operatively connecting said plurality of roller assemblies to said thumbwheel.

13. A cleaning tool for a vacuum cleaner having a main body portion and a height adjustment mechanism as claimed in claim 9 further including a biasing force between said thumbwheel and said clutch member, said biasing force biasing said thumbwheel away from said clutch member.

14. A cleaning tool for a vacuum cleaner assembly having a main body portion and a height adjustment mechanism as claimed in claim 13 wherein said mounting bracket includes a first engaging surface and said clutch member includes a second engaging surface, said second engaging surface biased against said first engaging surface by said biasing force.

15. A cleaning tool for a vacuum cleaner having a main body portion and a height adjustment mechanism as claimed in claim 14 wherein said first engaging surface includes a plurality of recesses and said second engaging surface includes at least one protrusion, said at least one protrusion received in one of said plurality of recesses when said clutch member is at said clutched position and said at least one protrusion displaced from said one of said plurality of recesses when said clutch member is at said de-clutched position.

16. A cleaning tool for a vacuum cleaner having a main body portion and a height adjustment mechanism as claimed in claim 14 wherein said first engaging surface includes a plurality of holes and said second engaging surface includes at least one protrusion, said at least one protrusion received in one of said plurality of holes when said clutch member is at said clutched position and said at least one protrusion displaced from said one of said plurality of holes when said clutch member is at said de-clutched position.

17. A cleaning tool for a vacuum cleaner having a main body portion and a height adjustment mechanism as claimed in claim 9 wherein said key mechanism comprises:

a projecting neck portion having a rib and extending perpendicularly from said thumbwheel;

a boss portion having a hollowed central area with a channel extending perpendicularly from said clutch member; and said neck portion is slidably received in said boss portion thereby keying said thumbwheel to said clutch member.

18. A cleaning tool for a vacuum cleaner having a main body portion and a height adjustment mechanism as claimed in claim 9 wherein said at least one roller assembly further includes:

a shaft portion having a first end and a second end, said first end including a channel, said channel receiving said pivot bar, said second end having a yolk rotatably supporting a roller; and said main body portion includes a guide portion, said shaft portion slidably received in said guide portion.

19. A cleaning tool for a vacuum cleaner having a main body portion and a height adjustment mechanism as claimed in claim 18 wherein said roller assembly further includes a coil spring;

said coil spring slidably received on said shaft portion between said channel and said guide portion; and said coil spring biasing said channel away from said guide portion.

20. A method for cleaning a surface with a cleaning tool and providing an adjustment mechanism for said cleaning tool, said method comprising the following steps:

connecting a cleaning tool having a main body portion and rotating a brush member to a vacuum source;

moving a height adjustment mechanism having a clutch member to one of a plurality of positions to select a height above the cleaning surface for the cleaning tool;

supporting the main body portion at the selected height above a surface to be cleaned by at least one roller assembly connected to the height adjustment mechanism;

cleaning the surface by passing the cleaning tool over the surface; and retracting the at least one roller assembly into the main body portion, thereby collapsing the cleaning tool onto the surface in response to application of a predetermined force to the main body portion.

21. A cleaning tool for a vacuum cleaner assembly having a main body portion and a height adjustment mechanism, said height adjustment mechanism comprising:

at least one roller assembly supporting said main body portion and movable between at least one extended position and a retracted position relative to said main body portion;

a clutch member having a second engaging surface and rotatably secured to a mounting bracket having a first engaging surface;

a thumbwheel rotatably secured to said mounting bracket and mechanically connected to said roller assembly, said thumbwheel slidably keyed to said clutch member, rotation of said thumbwheel moving said roller assembly between said at least one extended position and said retracted position;

a biasing member located between said thumbwheel and said clutch member, said biasing member biasing said second engaging surface of said clutch member against said first engaging surface of said mounting bracket;

said clutch member movable between a clutched position and a de-clutched position when a predetermined force is applied to said main body portion;

said clutch member maintaining said roller assembly at said at least one extended position when said clutch member is at said clutched position and permitting said roller assembly to move to said retracted position when at said de-clutched position.

* * * * *